United States Patent [19]

Schaefer et al.

[11] 4,031,181

[45] June 21, 1977

[54] METHOD FOR MOLDING HIGH STRENGTH FACING

[75] Inventors: William H. Schaefer; Richard E. Bender, both of San Diego, Calif.

[73] Assignee: General Dynamics Corporation, San Diego, Calif.

[22] Filed: May 10, 1976

[21] Appl. No.: 684,525

Related U.S. Application Data

[60] Continuation of Ser. No. 550,259, Feb. 18, 1975, abandoned, which is a division of Ser. No. 332,956, Feb. 15, 1973, Pat. No. 3,889,951, which is a continuation-in-part of Ser. No. 241,176, April 5, 1972, Pat. No. 3,840,230.

[52] U.S. Cl. ..... 264/135; 264/136; 264/137; 264/258

[51] Int. Cl.[2] ..... B29D 3/02

[58] Field of Search ..... 264/136, 137, 135, 258

[56] References Cited

UNITED STATES PATENTS

| | | | |
|---|---|---|---|
| 2,749,266 | 6/1956 | Eldred | 264/137 |
| 3,349,157 | 10/1967 | Parsons | 264/137 |
| 3,483,055 | 12/1969 | Eshbaugh | 273/73 F |
| 3,493,240 | 2/1970 | Jenks | 273/73 F |
| 3,619,448 | 11/1971 | Palfreyman | 264/103 |
| 3,657,040 | 4/1972 | Shobert | 264/137 X |
| 3,755,037 | 8/1973 | Erwin | 273/73 F |
| 3,993,308 | 11/1976 | Jenks | 264/258 X |

FOREIGN PATENTS OR APPLICATIONS

| | | | |
|---|---|---|---|
| 1,207,840 | 10/1970 | United Kingdom | 273/73 |

*Primary Examiner*—Richard R. Kucia
*Attorney, Agent, or Firm*—John R. Duncan

[57] ABSTRACT

A composite game racket having improved stiffness and uniformity and method of making same. Rackets are light bats consisting of a netting stretched in an open frame attached to a handle and which are used for striking the ball in tennis and similar games. The racket comprises a shell with a high strength fiber reinforced plastic facing laminated to each face of the shell. A preferred fiber orientation in the novel facing is disclosed. The facing is made by a method including steps of arranging a resin impregnated fiber tow in a mold, placing resin impregnated fiber cloth sheets over the tow in a specific selected arrangement and curing the resin under pressure in the mold. The shell may be internally recessed in a truss-like pattern to provide lightness with strength. The handle of the racket includes a pair of plastic pallets secured to the handle portion of the shell and covered with a covering material, such as a thin leather strip winding. The finished racket is finally strung in a conventional manner and is then ready for use.

4 Claims, 18 Drawing Figures

METHOD FOR MOLDING HIGH STRENGTH FACING

CROSS-REFERENCE TO RELATED APPLICATION

This application is a continuation of U.S. patent application Ser. No. 550,259 now abandoned, filed Feb. 18, 1975, which is a division of U.S. Patent application Ser. No. 332,956, filed Feb. 15, 1973, now U.S. Pat. No. 3,889,951 which is a continuation-in-part of U.S. patent application Ser. No. 241,176, filed Apr. 5, 1972, now U.S. Pat. No. 3,840,230.

BACKGROUND OF THE INVENTION

This invention relates generally to tennis rackets or the like and, more specifically, to a racket formed from reinforced plastic materials.

Strung rackets for use in tennis and similar games have long been made from solid wood and strung with gut or nylon strings. Manufacture of high quality rackets is a complex process. Despite great care in manufacture, the playing characteristics of wood rackets vary greatly due to natural variations in the wood used and manufacturing process variables.

Playing characteristics of wood rackets also vary with changes in temperature and humidity and with age of the racket, which changes may also cause the head to warp due to varying string tension.

Recently, steel and aluminum rackets have been developed in order to obtain greater uniformity. However, it has been found that these metal rackets do not provide the same playing qualities as wood rackets, since sufficient stiffness cannot be provided without excessive weight. Also, metal rackets frequently have short useful lives, due to cracking apparently caused by metal fatigue or stress concentrations.

Rackets are also being manufactured from fiberglass reinforced plastics. These rackets, however, generally are overly flexible and do not provide the desired stiffness for equivalent weight. Also, they lack uniformity and are expensive due to the number of manual manufacturing steps.

No matter which material has been used, there have always been problems in providing sufficient strength in the racket head to resist stresses during stringing of the racket. As stringing progresses, severe stress concentrations result in portions not yet supported by strings. As stringing continues, the locations of stress concentrations shift. The racket frame may severely warp or break due to these stresses if the frame lacks the strength and stiffness to resist the stresses induced by the very taut strings. Generally, attempts to strengthen the frame by increasing its cross-section area have not been successful due to the resulting weight increase and balance shift to the head.

Thus, there is a continuing need for rackets of improved strength, stiffness and playing characteristics.

SUMMARY OF THE INVENTION

It is, therefore, an object of this invention to provide a method of making a racket facing of improved strength and stiffness.

Another object of this invention is to provide a method of making a facing for a racket having improved resistance to stringing stresses.

Still another object of this invention is to provide a simple and consistent method of manufacturing rackets.

The above objects, and others, are accomplished in accordance with this invention by a method for making a facing and assembling a racket for tennis or the like which basically comprises a shell with a high strength fiber reinforced plastic facing laminated to each face of the shell. Preferably, the facing includes both continuous fibers following the facing shape and transverse fibers. The facing is made, basically, by placing a resin impregnated tow in a mold, placing resin impregnated fiber cloth sheets over the tow in a specific selected fiber orientation and curing the resin under pressure in the mold. The shell may have a truss-like internal structure which is covered by the facing. This preferred internal structure provides high strength with low weight and supports the strings in a desirable manner. Such a preferred shell may preferably be formed by injection molding, since this allows rapid production of a highly uniform product. The racket is completed by the addition of a pair of pallets to the handle portion of the shell, after which a surface layer of thin leather strips or the like may be wound around the handle portion to provide a desired gripping surface.

The racket may have any desired shape. In general, an elliptical or round frame is preferred. The method of the present invention is adaptable to a wide variety of frame shapes.

The racket shell may be formed from any suitable material having the required properties. The shell material should have high stiffness, good impact resistance, good dimensional stability and high fatigue resistance. Typical shell materials include wood (which may be solid or thin plies laminated together or to plies of other materials), metals such as aluminum, titanium, magnesium, or steel, synthetic resins (which may be reinforced with fibers such as plastic, glass, graphite or boron fibers) or a combination of these materials. Polycarbonate and polyphenylene oxide resins are preferred shell materials since they may easily be injection molded to produce shells of complex configuration and these materials have a flexural modulus in a preferred $2 \times 10^5$ to $20 \times 10^5$ psi range and an Izod impact resistance in the preferred range of from about 2 to 15 ft.-lb./in. (notched bar). Where at least a portion of the shell comprises such a synthetic resin, the resin may include fillers or additives to improve desired properties. Typically, glass, boron or graphite fibers may be added to the resin. For example, up to 40 volume per cent randomly chopped glass fibers, typically having lengths of from about 0.1 to 0.25 inch may be added to improve strength properties. While the shell may be solid shell material, it is generally preferred to recess the faces and the handle portion in a truss-like pattern to reduce shell weight. Where the shell primarily comprises a molded or formed metal or resin, the pockets which produce a truss-like internal configuration may be easily formed during the shell molding step. Where the shell is solid wood, desired recesses may be formed by a conventional routing operation. Where the shell is formed from laminated plies of wood or other materials, the recesses may either be pre-formed in the plies or routed out after the lamination step.

The weight of the shell is determined largely by shell thickness, the internal structure and the material selected. Where it is desired to market a line of similar rackets having different widths, varying shell thickness to vary the racket weight has been found to be convenient and effective. Alternatively, the thickness of any truss-like internal webs may be varied. If desired, any internal openings or pockets of the shell may be filled with a foamed synthetic resin. In a typical racket of the sort described herein, a reduction of the thickness of the shell in the plane of the racket of 0.05 inch provides approximately one ounce difference in shell weight.

The facing layers may comprise any suitable high strength fiber in a synthetic resin matrix. Best results are obtained with fibers having Young's modulus of from about $20 \times 10^6$ to about $80 \times 10^6$ psi and density of from about 0.05 to about 0.09 lb/in$^3$. Therefore, fibers having these properties are preferred. Especially suitable fibers include high-strength graphite fibers, such as those available from Union Carbide Corporation under the trademark "Thornel" and from Great Lakes Carbon, and high-strength organic fibers such as those available from E. I. duPont de Nemours & Co. under the trademark PRD-49.

The high-strength fibers may be imbedded in any suitable synthetic resin. The resin selected should have high impact resistance, good dimensional stability and good peel strength. In general, best results are obtained with epoxy, polyester, polyimide and phenolic resins.

Preferably, a plurality of layers of substantially parallel fibers make up the main portion of the facing. The main fibers in the body of the facing preferably are oriented with the fibers in a parallel arrangement from the handle portion, around the racket face and back to the handle. This provides maximum strength and stiffness in the desired directions. For optimum results and long racket life, at least one layer of fiber "cloth" may be bonded to the fiber body portion. This cloth may have about 50% each warp and woof fibers, or may be up to 100% warp fibers, in which case the cloth will consist of a single layer of parallel contiguous fibers. While this single layer form is preferred as part of a multi-layer facing, the cloth may be woven or matted, if desired. The transverse fiber layer may be at any suitable position in the facing laminate. However, it is preferred that the transverse fiber layer be at the outer surface of the facing, away from the shell. If desired, surface layers may be formed on the facing for appearance, surface smoothness, or other desired purposes. The handle pallets may be formed from any suitable material, such as wood or plastic. Acrylonitrile-butadienestyrene (ABS) polymers are preferred, since they are inexpensive, easily injection molded, and are sufficiently flexible to give a desired handle "feel". If desired, any suitable covering material, such as leather, fabric or plastic sheet or strip material, may be added over the racket handle to improve the grip characteristics. Typically, the circumference of the racket grip (circumference of the pallets plus the leather or other covering) ranges from about 4 to 5 inches. Preferably, eight different pallet moldings are prepared, ranging from 4 to 5 inches in circumference in ⅛-inch increments, so that the racket can be sized to meet any player's preference.

BRIEF DESCRIPTION OF THE DRAWING

Further details of the invention will be understood upon reference to the drawing, which illustrates a preferred embodiment of the racket of this invention.

In the drawing.

DETAILED DESCRIPTION OF THE DRAWING

Figure 1:
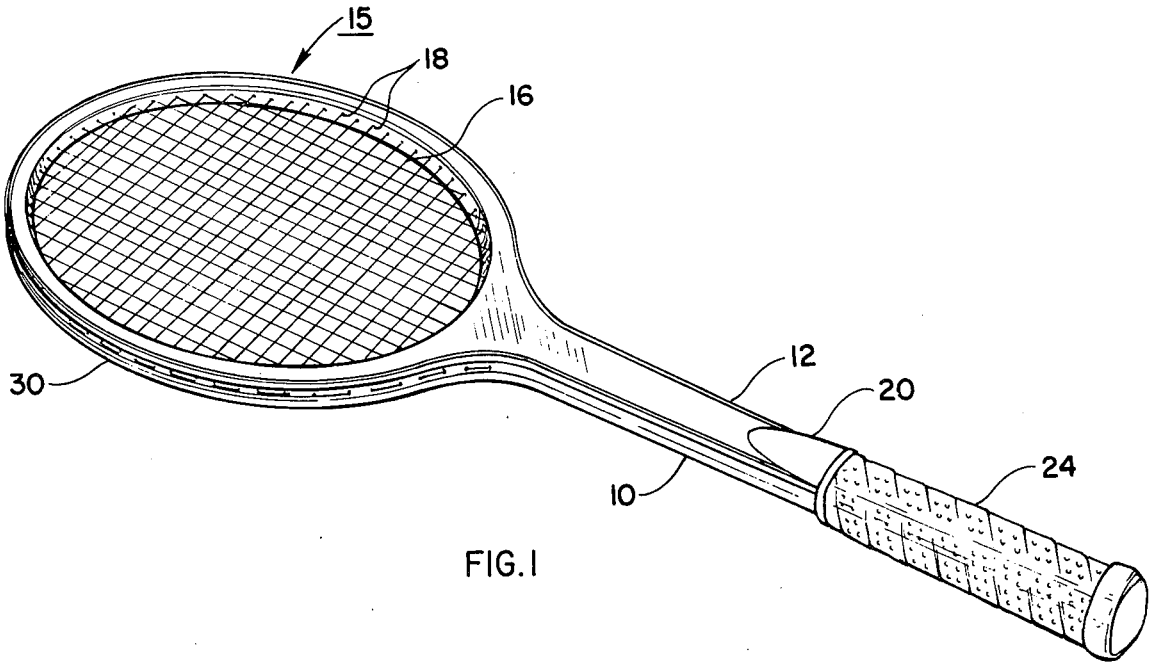
FIG. 1 is a perspective view of a complete racket.

An overall view of a complete, strung, tennis racket is shown in FIG. 1. The racket basically consists of a shell 10 having a fiber reinforced plastic facing 12 on each face. The racket frame or head portion 14 is strung with a taut gut or nylon string 16 which passes through a plurality of transverse holes 18 in frame 14. A pair of pallets 20 are secured to the sides of handle portion 22 of shell 10 and wrapped with a thin covering 24 to provide a comfortable grip area.

Figure 2:
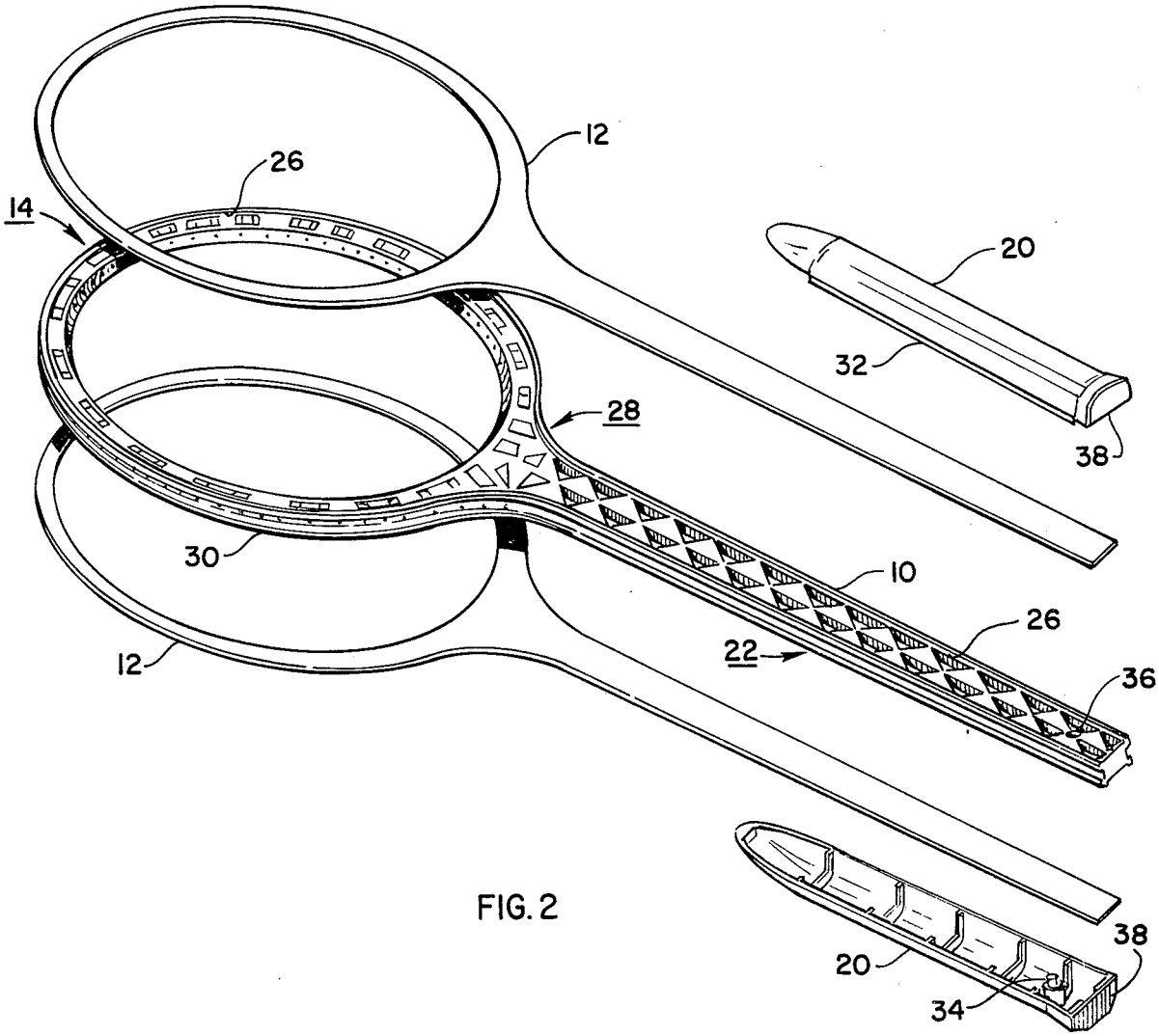
FIG. 2 is an exploded perspective view illustrating the major racket components.

The relationship of the major racket components can more clearly be seen in the exploded view of FIG. 2. Shell 10 is preferably recessed at 26 on each face to receive facing 12, giving a smoothly contoured outer surface to the completed racket. Alternatively, the faces of shell 10 could be smooth and facing 12 could cover the entire face of shell 10 or could be narrower and have tapered edges to blend into the shell faces. Behind recesses 26 shell 10 in this embodiment is pocketed in a truss-like pattern to provide maximum strength with minimum weight. These truss structures are hidden by facing 12 in the completed racket.

Facing 12 extends entirely around frame 14 to provide stiffness and strength to resist impact against a ball in play, and also to strengthen frame 14 against varying stresses in the plane of frame 14 during stringing. Facing 12 extends from frame 14 well down handle 22, adding strength to the racket throat portion 28, which is often weak in rackets made from other materials. Facing 12 also adds desired stiffness to handle 22. Stiffness of the different portions of the racket can easily be varied by varying the cross-sectional area or cross-sectional shape of the facing 12 at different locations to give the racket the desired playing characteristics.

A groove 30 is preferably provided in the outer surface of frame 14 so that the string is recessed as it passes between holes 18. This protects the string against abrasion, should the racket strike the court playing surface during use.

Pallets 20 substantially surround the ends of handle 22. Pallets 20 are securely held in place by sides 32 which extend around the sides of handle 22 and by pins 34 on pallets 20 which enter holes 36 in handle 22. The bases of pallets 20 are preferably recessed at 38 so that the manufacturer's trademark or other emblem may be emplaced there.

Facing 12 may be secured to shell 10 in any suitable manner. While pellets 20 are held in place by the interlocking effect of sides 32 and pins 34 together with the leather wrapping, they may also be adhesively bonded to shell 10, if desired.

When assembled as illustrated in FIG. 1, the resulting racket has outstanding strength, stiffness and playing characteristics. These characteristics result in large measure from the configuration and composition of the component parts, which are illustrated in detail in the remaining figures.

Figure 3:
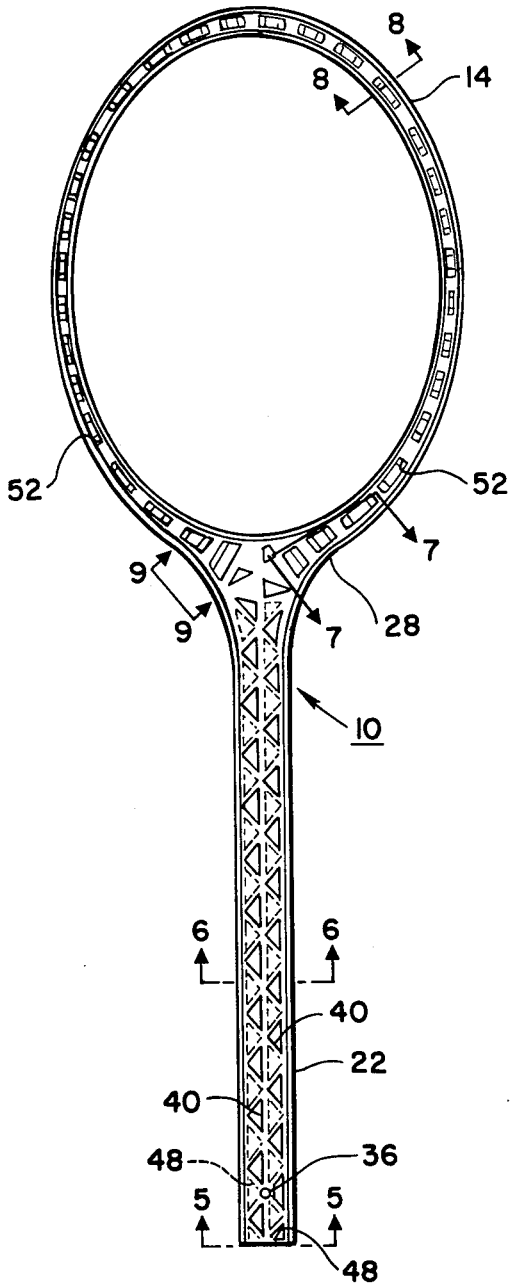
FIG. 3 is a plan view of the face of the racket.
Figure 4:
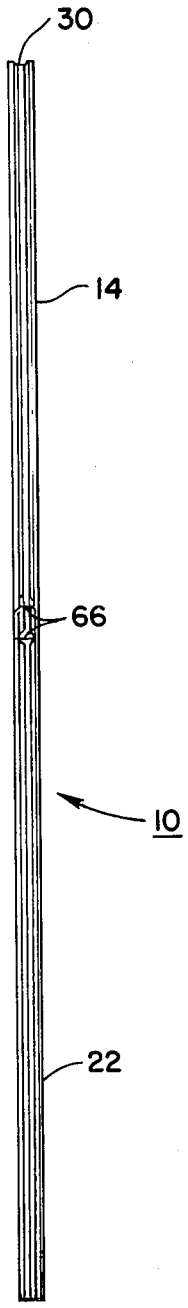
FIG. 4 is a side elevation view of the racket shown in FIG. 3.

The top of shell 10 is shown in FIG. 3 and the side of the shell in FIG. 4. This is a single unitary member which is preferably formed from a polycarbonate resin in a single injection molding step. The truss-like pattern of pockets in shell 10 is arranged so as to permit convenient production in a single simple mold.

Figure 5:
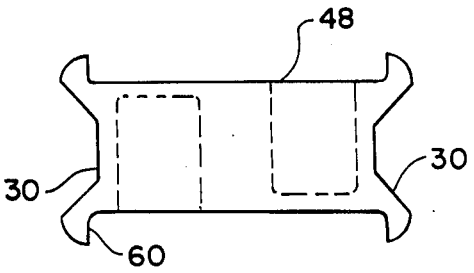
FIG. 5 is an enlarged detail view showing the base of the racket taken on line 5—5 in FIG. 3.
Figure 6:
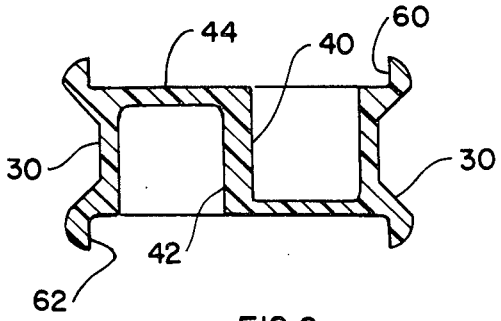
FIG. 6 is an enlarged section view through the racket handle, taken on line 6—6 in FIG. 3.

As best seen in FIGS. 3, 5, and 6, the handle portion 22 can be thought of as a solid polycarbonage member with a plurality of triangular recesses or pockets 40 extending nearly through the handle alternately from the upper and lower surfaces thereof. Pockets extending upwardly in FIG. 3 are illustrated by broken lines 42. This produces a very strong truss-like structure with very light weight, since the webs between adjacent pockets 40 and hidden pockets 42 are thin, and the base 44 of each pocket is thin, as seen in FIG. 6.

As seen in FIGS. 3 and 5, the base of handle 22 is closed by an end wall 48. Also, the sides of handle 22 are grooved in a continuation of groove 30 which surrounds frame 14 to protect the racket strings against abrasion should the playing surface be struck during play. Groove 30 serves to reduce the weight of handle 22 while retaining strength and stiffness. The upper and lower surfaces of handle 22 include a depression or recess 48 sized to receive the handle portion of facing 12. When bonded in place, facing 12 covers and hides the truss arrangement produced by the array of pockets 40 and 42.

As seen in the lower portion of FIG. 3, a depression or hole 36 is formed to receive a locating pin on pallets 20, as further described below.

Figure 7:
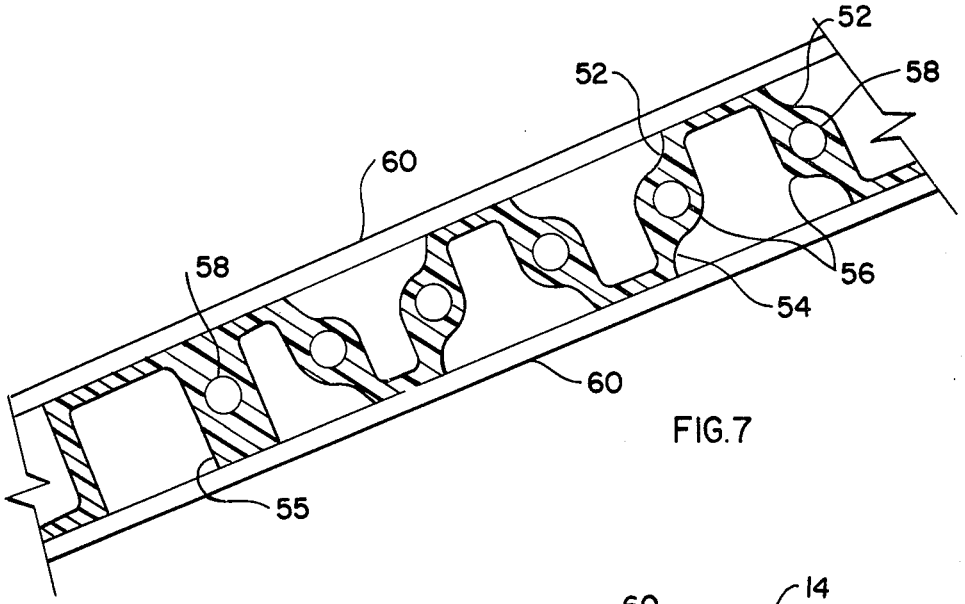
FIG. 7 is an enlarged section view through the racket throat and frame, taken on line 7—7 in FIG. 3.

Moving up the handle as seen in FIG. 3, the pattern of pockets changes in throat area 28 to a pattern around frame 14 which accommodates stringing holes. As shown in section in FIG. 7, which illustrates the transition between throat 28 and frame 14, pockets 52 in the upper face of frame 14 and pockets 54 in the lower face of frame 14 alternate around the frame to produce a truss-like web between adjacent pockets. Web 55 is the final handle web before the frame pocket pattern develops. A transverse thickened portion 56 is formed in each inter-pocket web through which a stringing hole 58 may be formed. The stringing holes 58 may either be produced during the molding operation by removable pins positioned in the mold, or may be drilled after molding of the shell. This arrangement in which stringing holes 58 penetrate through solid portions of shell 14 is highly desirable both from a strength standpoint and because only two apertures need be deburred or smoothed to prevent abrading the string. If the holes penetrated through a pocketed area, there would be four surface apertures to be smoothed.

Figure 8:
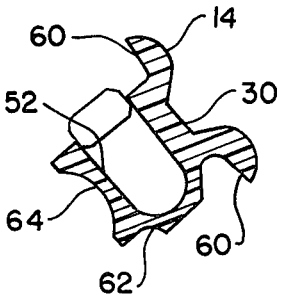
FIG. 8 is an enlarged transverse section view through the racket frame, taken on line 8—8 in FIG. 3.

A transverse section through shell 14 is seen in FIG. 8. The frame faces are preferably recessed, with upstanding edges 60, so that when facing 12 is bonded in place the outer facing surface will bend smoothly into edge 60. As described below, the facing is preferably grooved in the frame area, producing a broad "U"-shaped cross-section. A ridge 62 is provided around frame 14 to fit precisely within the facing groove, assuring excellent bonding between facing 12 and shell 14. As discussed above, a string-protecting groove 30 is provided in the outer edge of frame 14. Also, a groove 64 of generally semicircular cross-section is provided in the inner edge of frame 14 to reduce weight while retaining maximum strength.

Figure 9:
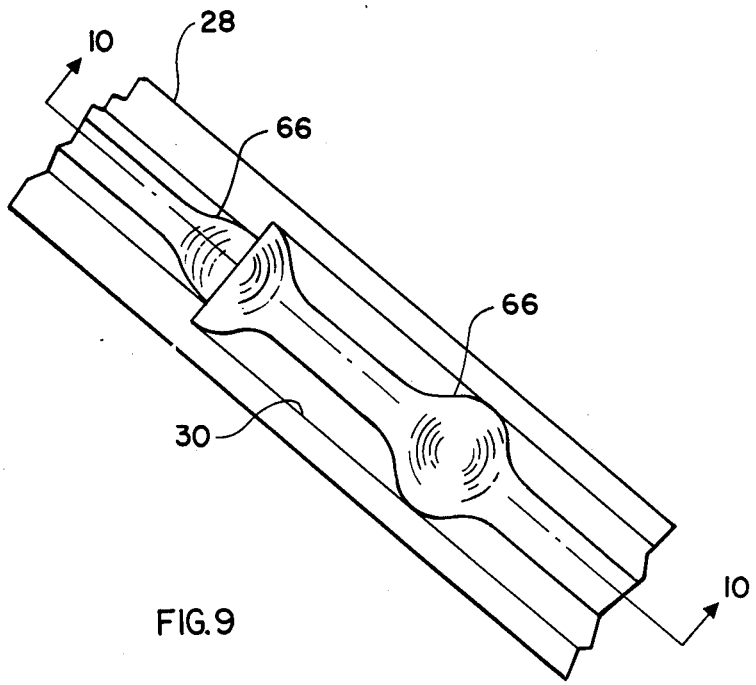
FIG. 9 is a longitudinal detail view of a portion of the frame, taken on line 9—9 in FIG. 3.
Figure 10:
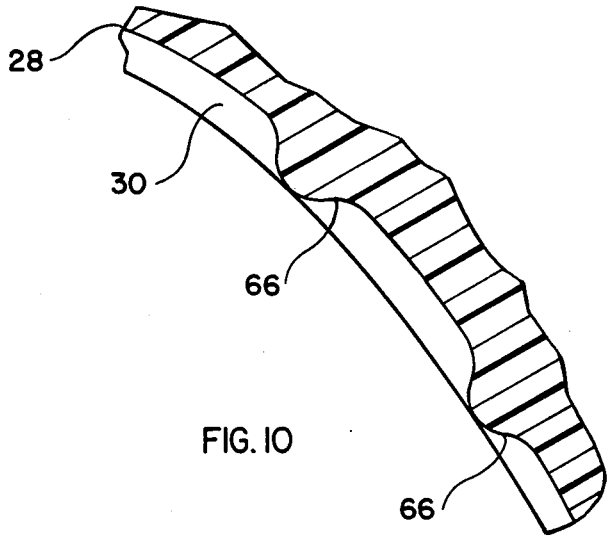
FIG. 10 is an enlarged section view through the racket frame, taken on line 10—10 in FIG. 9.

FIGS. 9 and 10 illustrate a pair of raised areas 66 within groove 30 adjacent to racket throat 28. In the groove area, the angle between the string as it lies within groove 30 between string holes 58 and the string as it lies with holes 58 in this area is an acute angle. This sharp angle as the string changes direction upon entering holes 58 has been found to damage the string. Raised areas 66, properly positioned within groove 30, relieve these severe localized stresses.

Figure 11:
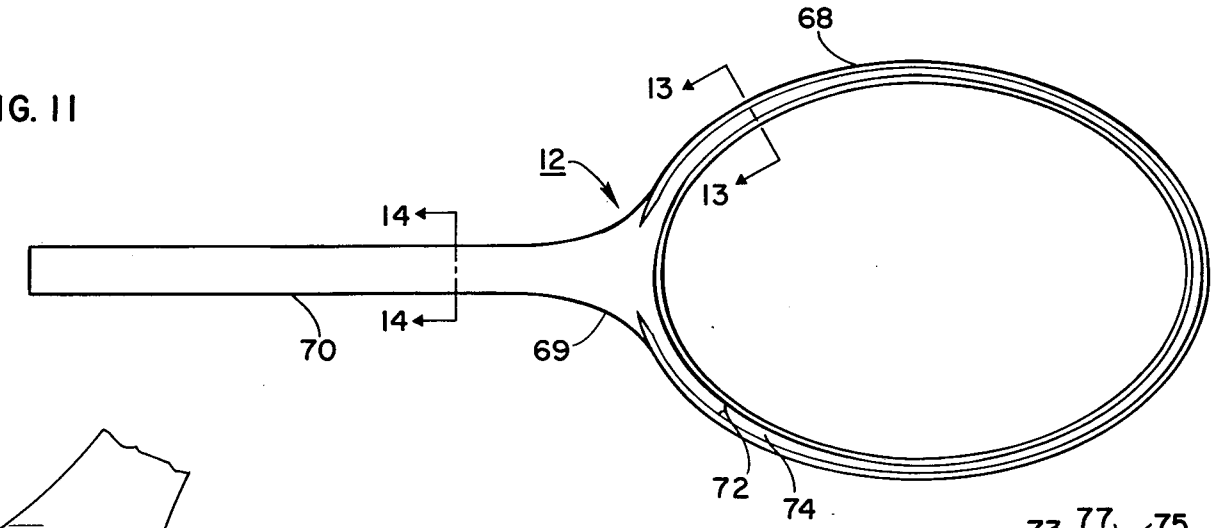
FIG. 11 is a plan view of the facing.
Figure 12:
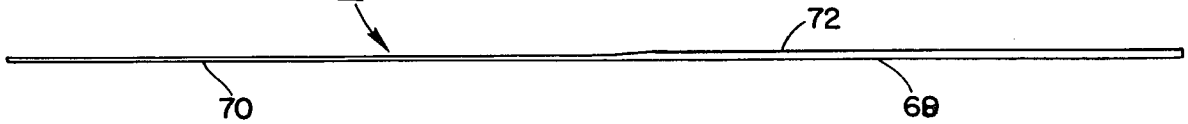
FIG. 12 is a side view of the facing.

Details of the facing members 12 can be seen in FIGS. 11 and 12. The facing generally consists of a frame portion 68, a throat portion 69, and a handle portion 70. Handle portion 70 may have a constant cross-section, or may taper in thickness and/or width to vary the stiffness characteristics of the completed racket handle. As seen in section in FIG. 13, frame portion 68 has a broad U-shaped cross-section, with raised edges 72 bounding a central groove 74. Ordinarily the thickness of the facing material in the area of groove 74 is about one-half the thickness of the facing in the handle portion 70. It has been found that the raised edges 72 add greatly to the strength of the facing and racket frame 14 without adding appreciably to the weight of the racket. Typically, the facing may be about 0.070 to 0.090 inch thick in the handle 70 portion, with raised edges 72 and groove 74 having thicknesses in the range of about 0.110 to 0.130 inch and about 0.025 to 0.055 inch, respectively. Handle 70 typically may have a width in the range of from about 0.90 to 1.10 inches. The width of the facing in frame portion 68 may typically range from about 0.45 to about 0.65 inch.

Strength and stiffness in the frame area are especially important, since forces in the plane of frame 14 must be resisted during stringing, and ball impact forces in a direction substantially perpendicular to the plane of frame 14 must be resisted during play. As discussed above, groove 74 and raised edges 72 mesh with ridge 62 on shell 10 when facing 12 is bonded to shell 10.

Facing 12 consists essentially of high Young's modulus fibers in a resin matrix. As discussed above, high-strength graphite fibers are preferred, although other similar fibers may be used in at least portions of the facing to vary the physical characteristics thereof.

Figure 13:
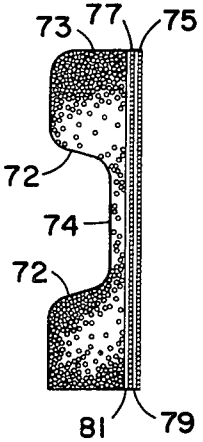
FIG. 13 is an enlarged section view through the facing frame, taken on line 13—13 in FIG. 11.
Figure 14:
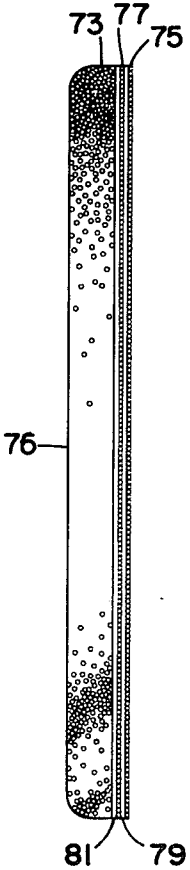
FIG. 14 is an enlarged section view through the facing handle, taken on line 14—14 in FIG. 11.

It is ordinarily preferred to have most of the facing fibers in the form of continuous substantially parallel fibers running up handle 70, around frame 68 and back down handle 70. As described above, for best results, it is strongly preferred to have at least two layers of fiber cloth with the fiber orientation substantially transverse to the orientation of the fibers in the facing body. Preferably, this is accomplished as illustrated in FIGS. 13 and 14, by first forming fibers in resin impregnated tow form to produce the body 73 of the facing 12. In the preferred embodiment shown in FIGS. 13 and 14, the body 73 has a generally U-shaped configuration in the frame 68 area and a generally rectangular configuration 76 in the handle 70 area. In throat 69, the inner leg of the "U" continues around the frame while the outer leg tapers down to the rectangular form. Of course, if the face of shell 10 were flat, the entire inner surface of facing 12 could be similarly flat. At least two, and preferably four, layers of fiber cloth are preferably arranged on one side of body 73 with fibers running transverse to the fibers in body 73. Each cloth layer preferably consists of a single layer (100% warp) of parallel contiguous resin-impregnated fibers. With the handle 70 assumed to lie along the "0°" orientation, it is preferred that the first ply 75 and the second ply 79 and fourth ply 81 have a "90°" orientation. Any other suitable orientation may be used, although for best results alternate plies should be oriented at least 45° to each other.

Figure 15:
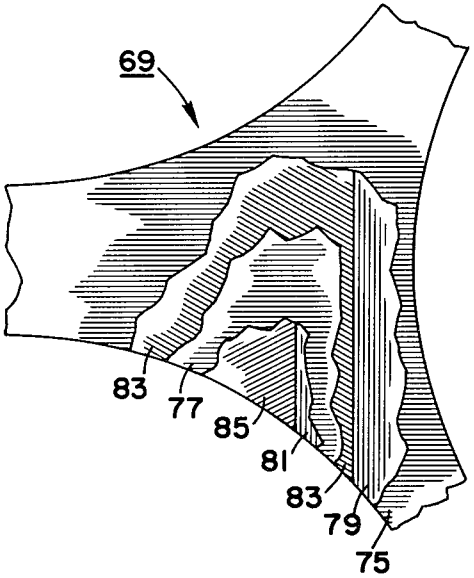
FIG. 15 is an enlarged, partially cut-away plan view of the throat area of the facing.

While optimum performance has been obtained with these four 90° plies around frame 68, it has been found that the orientation of the overlayers should be different in throat 69 and handle 70. As seen in the cut-away portion of FIG. 15, first ply 75 and third ply 77, which are at 0°, may continue down through throat 69 and handle 70. The fine lines in FIG. 15 illustrate fiber orientation, rather than hatching. However, second ply 79 and fourth ply 81, which were at 90° in frame portion 68, should change to an angle between 0° and 90°, preferably between 30° and 60°. As illustrated, ply 79 becomes ply 83 and ply 81 becomes ply 85. Excellent results have been attained where second ply 83 is at +30° and fourth ply 85 is at −30° in most of throat 69 and all of handle 70. The lines at which these plies change over from 90° to ± 30° should be staggered slightly as shown in FIG. 15.

More or fewer transverse fiber layers may be used, so long as succeeding layes in frame 68 are at least 45° to each other and so long as the fiber layers in lower throat 69 or handle 70 are at least 30° to each other and no more than 60° to the centerline of handle 70.

If desired, as mentioned above, fibers of different composition may be used in different parts of facing 12 to vary its physical characteristics. For example, boron fibers might be used in place of some of the graphite fibers in handle 70 to increase its stiffness, or some glass or PRD-49 fibers could be used in body 73 to vary the stiffness of frame 68.

Figure 16:
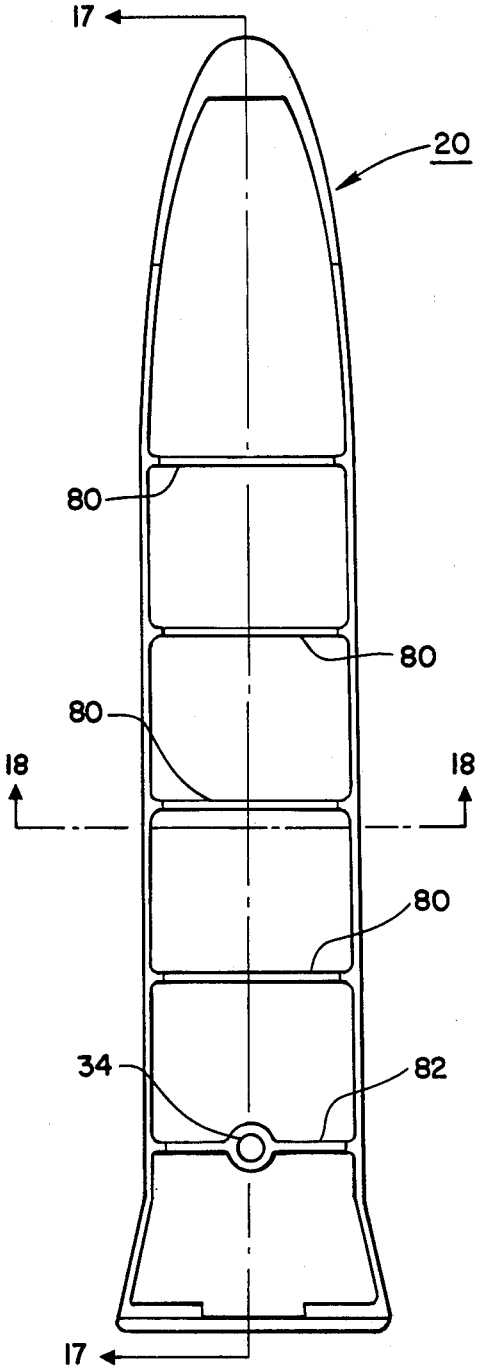
FIG. 16 is a plan view of a handle pallet.
Figure 17:
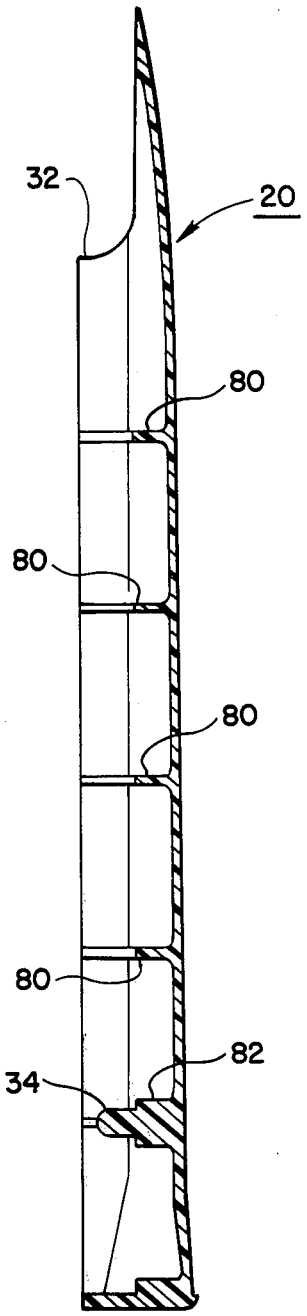
FIG. 17 is a section view of the pallet taken on line 17—17 in FIG. 16.
Figure 18:
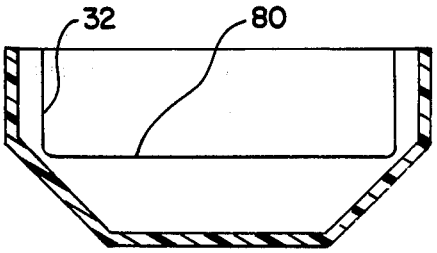
FIG. 18 is an enlarged section view through the pallet, taken on line 18—18 in FIG. 16.

Details of the handle pallets 20 are shown in FIGS. 16, 17, and 18. FIG. 16 shows the side of pallet 20 which fits against shell handle 22. The outer surface configuration of pallet 20 can be seen in FIG. 2. When installed, pallets 20 substantially surround handle portion 22. Ribs 80 add strength and rigidity to the pallets and rest on the surface of handle 22. Rib 82 includes an outwardly extending pin 34 which engages hole 36 in handle 22 to locate the pallet in the desired position. If desired, pallets 20 may be adhesively bonded to handle 22, though this is not always necessary. After pallets 20 are fitted in place, a winding of thin leather or the like is applied to give a desired gripping surface, as shown in FIG. 1. The racket is then ready for stringing and use.

While the method of manufacturing these rackets has been described in general terms, a preferred embodiment of this method is provided in the following example.

EXAMPLE

A mold is prepared for the racket shell 10 in the configuration described above and shown in the drawing. An injection molding material comprising "Lexan" polycarbonate resin, available from General Electric, filled with 10% chopped glass fibers is prepared and injected into the mold. After completion of the molding operation, 0.136-inch diameter holes 58 are drilled through thickened areas 56 to receive the racket strings. Although typical strings are only about 0.05-inch in diameter, the larger sized hole is used in order to accommodate double strings either as part of the basic stringing arrangement or to allow for repairs.

A pair of facing members 12 is prepared by compression molding. Material for the facing bodies is a Type A graphite filament preimpregnated with an epoxy resin, available from the Fiberite Company under the X505 designation. This material is in the form of continuous tows about 57 inches long. Successive tows are laid up in a pre-compaction die and overlaid with four plies of graphite fibers (available from Union Carbide Corporation) oriented at 0°, 90°, 0° and 90°. The layup is then placed in the facing forming die, compacted at about 50 psi and cured at about 250° F for about 30 minutes. After minor cleanup and removal of flash, the facings are ready for installation on the shell. The transverse layers become an integral part of the facing and provide crosstension strength to the laminate.

The surfaces of the shell and facing are prepared for bonding with a light sandblast and a liquid Freon (a fluorocarbon liquid available from E. E. duPont de Nemours & Co.) wipe just prior to bonding to insure a good "tooth" and a clean interface. The facings are boned to the shell with an epoxy resin, Epoxy 934, available from the Hysol Chemical Co. About 10 psi mechanical pressure is applied during bonding. Excess adhesive which may squeeze out is removed immediately.

After the facing adhesive is cured, the racket is inspected, tested, any desired decals are applied and a urethane resin finish coat is applied. The coating is dried at about 120° F for about 8 hours to drive off all volatiles.

A pair of pallets 20 as shown in the drawing are injection molded from Cycolac resin, an acrylonitrile-butadiene-styrene resin available from the Morbon Chemical Division of the Borg-Warner Corporation. The pallets are bonded to the racket with conventional contact cement. The pallets are coated with a grip adhesive, Inco No. 155 from the Intercoastal Corp. The leather grip material is installed over the pallets, after which the grip adhesive is activated by applying a solvent through the leather covering.

Finally, any desired labels or identification symbols are applied and the racket is strung in a conventional manner. The racket is found to have excellent playing characteristics and durability.

While certain specific materials, arrangements and conditions are specified in the above description of a preferred embodiment, these may be varies or other materials of steps added where suitable, with similar results as described above. For example, fibers of different characteristics may be added to different facing areas to modify racket characteristics as desired, or more or fewer fiber cloth layers may be used in different facing areas to vary strength and stiffness characteristics.

Other modifications and ramifications of the invention will become apparent to those skilled in the art upon reading the present disclosure. These are intended to be included within the scope of this invention, as defined in the appended claims.

We claim:

1. The method of making a reinforcing facing for a game racket having an open frame connected to an elongated handle by a throat area which comprises:

impregnating a tow of substantially continuous, substantially parallel high Young's modulus fibers with a synthetic resin;

arranging said tow in a mold having an open frame area connected to a handle area by a throat area;

molding said tow into a substantially U-shaped cross-section in the frame area, modified through the throat area to a substantially rectangular cross-section in the handle area;

impregnating at least two sheets of high Young's modulus fiber cloth with a synthetic resin, said cloth having from about 0 to 50% woof fibers and from about 50 to 100% warp fibers;

placing said at least two sheets of fiber cloth over said tow in said mold so as to contact the base of said U-shape and cover the frame area, handle area and throat area;

placing said sheets of cloth with the warp fibers in each succeeding layer in the frame area at an angle of at least about 45° to the fibers in the preceding layer and placing said layers of cloth in the handle area at an angle of at least 30° to the fibers in the preceding layer, the warp fibers in all layers in the handle area being placed at angles of no more than about 60° to the handle centerline; and applying pressure to said mold and hardening said resin to form a unitary facing comprising fibers in a resin matrix.

2. The method according to claim 1 wherein at least some sheets of said cloth comprise a substantially single layer of substantially parallel contiguous fibers.

3. The method according to claim 2 wherein four cloth sheets are laid up over said tow in said mold with fibers at angles to the handle centerline of about 0°, 90°, 0°, and 90° in the frame and upper throat areas and of about 0°, −30°, 0° and +30° in the handle and lower throat areas.

4. The method according to claim 1 wherein said mold forms said tow into a substantially U-shaped cross-section in the frame area, modified through the throat area to a rectangular configuration in the handle area, and said cloth layers are bonded to the base of said U-shape.

* * * * *